US005768812A

United States Patent [19]

Cross

[11] Patent Number: 5,768,812

[45] Date of Patent: Jun. 23, 1998

[54] DISPLAY MOUNT APPARATUS

[76] Inventor: Carroll N. Cross, 3202 Holiday Ave., Apopka, Fla. 32703

[21] Appl. No.: 540,846

[22] Filed: Oct. 11, 1995

[51] Int. Cl.[6] ..... G09D 3/04

[52] U.S. Cl. ..... 40/120; 283/2; 283/58

[58] Field of Search ..... 40/120; 248/459, 248/460, 465; 281/33; 283/2–4, 57, 58

[56] References Cited

U.S. PATENT DOCUMENTS

| | | | |
|---|---|---|---|
| 1,784,736 | 12/1930 | Lear | 281/33 |
| 3,002,720 | 10/1961 | Cross | 40/120 X |
| 3,013,359 | 12/1961 | Cross et al. | 40/120 X |
| 3,068,139 | 12/1962 | Cross | 40/120 X |
| 4,975,137 | 12/1990 | Cross | 40/120 X |

FOREIGN PATENT DOCUMENTS

| | | | |
|---|---|---|---|
| 701767 | 1/1941 | Germany | 283/4 |

*Primary Examiner*—Cassandra H. Davis
*Attorney, Agent, or Firm*—William M. Hobby, III

[57] ABSTRACT

A display mount apparatus has three panels hinged together with a single ductile hinge to form a calendar display with two covered display panels and an easel panel. A calendar is stapled to one of the display panels through the covering and through the ductile hinge to force the ductile hinge to bend along a predetermined hinge line. A method of making a display mount includes attaching a ductile hinge between first and second panels, then cutting an easel panel from a portion of the first panel and into the ductile hinge to form the easel panel already attached to the ductile hinge. The first panel may be a single panel or may be folded, in a face-to-face relationship so that the attached easel portion on one side can be rotated on the ductile hinge from one side of the folded first panel. The back of the first panel and one side of the easel panel may have printing thereon.

6 Claims, 1 Drawing Sheet

DISPLAY MOUNT APPARATUS

BACKGROUND OF THE INVENTION

The present invention relates to a display mount and to a process for making a display mount having three panels hinged to each other with a single ductile hinge.

In the past, a great variety of displays for displaying calendars and the like have been provided. Typically, these display mounts are made of paperboard panels which have a plurality of calendar leaves attached by staples, stitches, or placed in pockets on the display mount. The display may be provided with some means for supporting the display, such as having a rear hinged panel to hold the panels in position. These prior type displays are frequently provided free by companies to their customers and potential customers with their advertising material printed on the display mount. The present invention is directed toward a method of making a multi-use calendar display which may contain a pen or pencil holder using a panel with a U-shaped slot therein.

Typical display mounts for calendar pads and the like may be seen in my prior U.S. Patents including U.S. Pat. No. 4,975,137 for a process for making a casebound hinged display mount having three rectangular panels and a pen holding slot formed on one edge of one of the rectangular panels to support a pen therein and includes attaching a thin aluminum strip hinge with a visible groove between two of the panels. In U.S. Pat. No. 4,288,935, a display and book combination allows for a calendar combination which swings to give access to a phone or reference book. Three panels are used with two being connected with a ductile hinge. In U.S. Pat. No. 4,696,118 for a Desk Calendar, a display mount has paperboard panels with three of the panels being hinged together with flexible hinges while two of the panels are connected with one ductile hinge. In my prior patent for a Display Book Apparatus, U.S. Pat. No. 4,288,935, I have combined a display and book combination which allows the calendar to swing forward to give access for a phone or reference book. In my U.S. Pat. No. 3,188,113, a paper holder has a V-shaped pen receptacle and has a display mount with a pencil or pen holder formed therein and requires a connected panel. In U.S. Pat. No. 3,002,720, a display mount is shown attaching panels together with a thin strip of aluminum so that the panels, once casebound, can be folded into position without having additional supports for the mount. In U.S. Pat. No. 4,351,123 for a Display Mount and Method, a plurality of casebound panels are connected together to define a hinge line between each pair of the hinged panels and a transparent polymer material overlays the casebinding material covering at least a portion of two panels and extending over the hinge area to form two transparent pockets.

In contrast to these and other prior Cross patents, the present invention is for a display mount method and apparatus in which three panels are hinged together with a single ductile hinge to provide an attractive, lightweight, and inexpensive calendar display.

SUMMARY OF THE INVENTION

A display mount having three panels are hinged together with one ductile hinge. The first display panel is hinged to a second display panel connected with a ductile hinge so that the first and second display panels can be positioned relative to each other and an easel panel is connected to the same ductile hinge but cut to hinge separately and positioned relative to the first and second panel so that a single ductile hinge hingedly supports the three panels together. A calendar pad is attached to the first display panel with staples extending along the edge of the panel and through the casebinding and through the ductile hinge to reinforce the attachment of the ductile hinge and which helps force the bending hinge line for the three panels. The first display panel may be a single panel or may be folded into a double panel which has the easel panel cut from the first display panel. The method of making the present display mount includes selecting first and second panels of predetermined size, which may include cutting a predetermined end portion of the selected first panel to form the second display panel from the first panel, and attaching a ductile hinge across the first and second panels. The method includes cutting an easel shape into a portion of the first panel and into the attached ductile hinge while leaving the ductile hinge attached thereto and may include folding one end of the panel over onto itself to form a double, face-to-face panel with the cut easel lines cut on one side. The folded first panel is attached in the folded position so that the easel panel can be pulled from one side of the folded panel on the ductile hinge. The method also includes attaching a calendar pad with staples to the folded first display panel by stapling through the panel casebinding and to the ductile hinge to force the bending of the hinge line along a predetermined line. A phone index may be printed on one side of the easel and on the back of the first panel.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
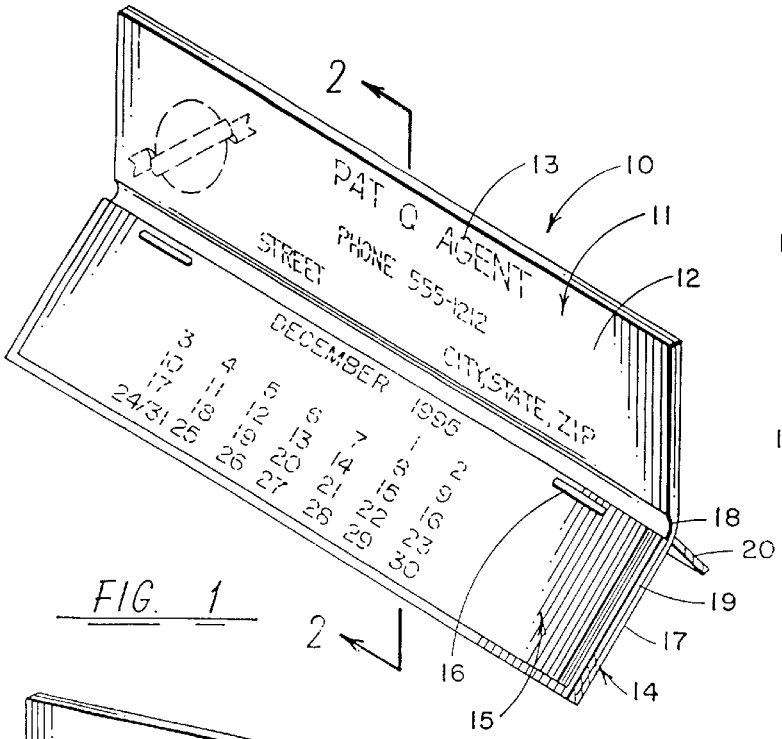
FIG. 1 is a perspective view of a display mount in accordance with the present invention.
Figure 2:
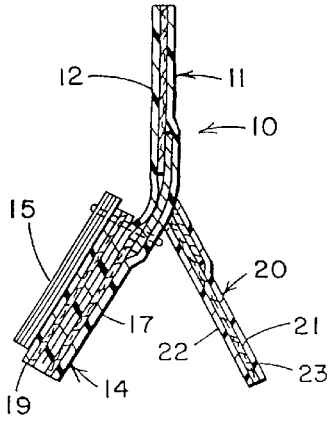
FIG. 2 is a sectional view of a display mount of FIG. 1 taken on line 2—2.

Referring to the drawings and especially to FIGS. 1 and 2, a display mount 10 is illustrated having a display panel 11 which has a casebinding 12 covering the front thereof and has indicia 13 imprinted on the face thereof. A panel 14 has a calendar pad 15 attached thereto with a pair of staples 16 and may be formed of a single panel or may have a folded double panel board having a rear panel portion 17 and a front panel 19. The panel 14 is connected to the panel 11 with a ductile hinge 18 which may consist of a thin strip of aluminum or aluminum alloy attached to the back of the panels 11 and 14 so that the panels can be bent relative to each other and to any angle desired where they will maintain their position. The first and second panels have been casebound together so that the staples 16 can pass through the casebinding 12 and into the ductile hinge 18 without passing through the panel 14 or by passing through only one of the folded panels. An easel panel 20 is casebound with a casebinding material 21 on one side and laminated with a paper, or the like, 22 on the other side of the paperboard panel 23. This panel is also attached to the ductile hinge 18 and can be rotated on the hinge 18 to any position desired. The hinge 18 is adhesively attached to the panels 11, 14 and 20 so that each panel can be rotated on the ductile hinge relative to the other two panels and thereby forms a double hinge. In addition, the staples 16 have been attached through the calendar pad 15 and through the casebinding 12 and through the ductile hinge 18 to further attach the ductile hinge to the panel 14 and also to grip the ductile hinge at a position to hold the ductile hinge as the panel 11 is being rotated relative to the panel 14. This assures the folding of the ductile hinge at the stapled hinge line.

Figure 3:
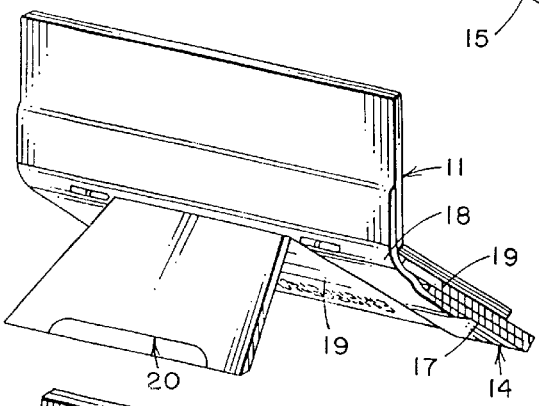
FIG. 3 is a rear perspective view of a display mount of FIGS. 1 and 2.
Figure 4:
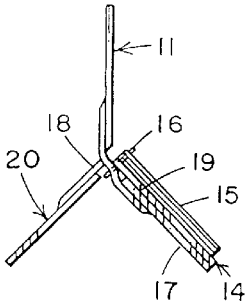
FIG. 4 is a diagrammatic view of the display mount of FIG. 4.

As illustrated in FIGS. 3 and 4, the display mount 10 has the panel 11 and is supported in position with the panel 14 and the easel panel 20, as shown in the diagrammatic view of FIG. 4 (with casebinding and laminates removed), and which also shows the staple 16 passing through the calendar pad 15 and through one of the double hinge panels 14 and through the aluminum hinge 18.

Figure 6:
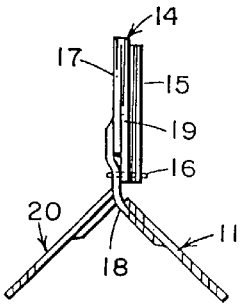
FIG. 6 is a diagrammatic view of the display mount of FIG. 5.
Figure 5:
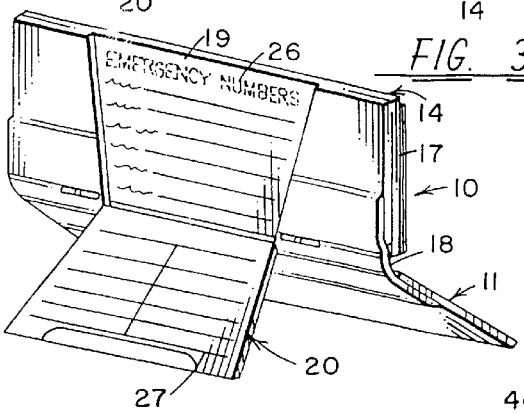
FIG. 5 is another perspective view of the display mount of FIGS. 1–4 having the display mount set upside down from the view shown in FIGS. 1 and 3.

In FIGS. 5 and 6, the display mount 10 has been turned upside down and the easel panel 20 rotated to a different position where it is held in position by the ductile hinge 18 thereby making the panel 11 a support panel holding the panel 14 in an upright position. In this view, it can be seen that the easel panel 20 has been cut out of the rear panel portion 17 of the panel 14 thereby exposing the rear of the front panel portion 19 of the panel 14 (or the rear of the calendar pad where panel 14 is a single panel) which can be seen having indicia lines 26 printed thereon. Similarly, lines 27 can be seen printed on the paper laminated rear of the easel panel 20. This advantageously allows the calendar, as displayed in FIG. 1, to be quickly tilted over to view emergency or frequently called phone numbers.

It can also be seen from the view in FIG. 5, that when the easel panel 27 is cut out of the rear panel 17, it merely requires three cuts, with cuts 24 and 25 extending into the ductile hinge 18, so that when the panel 20 is pulled from the display panel 14, it will bend on the hinge 18 and be held in position with the ductile hinge. The flexibility of having all three panels supported by the same ductile hinge allows the display to be positioned in a variety of positions, as shown in FIGS. 3 and 4 and again in FIGS. 5 and 6.

Figure 7:
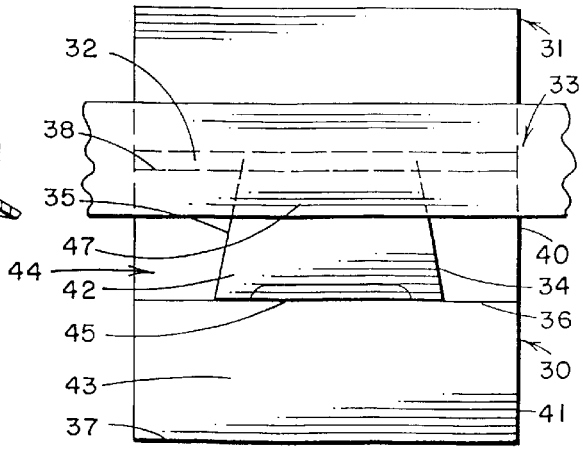
FIG. 7 is a top plan view of a partially made display mount in accordance with FIGS. 1–6.

The manufacture of the present display mount is simplified by the partial assembly as shown in FIG. 7 in which a paperboard panel 30 has a second panel 31, which may be cut from the panel 30, and spaced by a spacing 32 which spacing has been covered with a ductile hinge 33 which may be a thin strip of aluminum which is adhesively attached between the two panels 30 and 31. The easel cut lines 34, 35, and 45 form an easel in the panel 30 through a portion of the ductile hinge 33 and into the hinge space 32 between the panels 30 and 31. The panel 30 may be a single display panel or may be folded on the line 36, which may be creased or partially cut on the line 36. The folding of panel 30 forms the double panel having the panel edge 37 aligning with the panel edge 38. The folded panel can then be attached to form a double panel with the attachment being with casebinding over the edges 40 and 41 without binding the easel 42 to the front folded portion 43. Once the panel 30 has been folded on the line 30 and the portion 43 attached to the portion 44, the easel 42 can then be pulled loose along the cut line 45 and will bend on the hinge line of the ductile hinge 33 which is attached at 47 to the easel 42.

The manufacture of the display mount of FIGS. 1–6 is easily accomplished from one paperboard panel, as desired, which is cut into two panels connected by the ductile hinge 33 which has the easel panel 42 cut out of the panel 30 but without cutting the panel loose from the ductile hinge 33. The easel panel 42 is held by the ductile hinge 33 and rotates on the hinge in one direction while the panels 30 and 31 can be rotated relative to each other on the ductile hinge on either side of the easel panel 42 in a double hinge arrangement. In addition, the stapling of the calendar pad, as shown in FIGS. 1, 2, 4 and 6, through the casebinding and ductile hinge holds the ductile hinge 33 so that the bending of the ductile hinge when panels 30 and 31 are bent relative to each other, will take place in the center portion of the spacing 32.

It should be clear at this time that a simplified display mount having three panels all connected with a single ductile hinge has been provided which has great versatility and can be inexpensively manufactured. However, the present invention is not to be construed as limited to the forms shown which are to be considered illustrative rather than restrictive.

I claim:

1. A display mount comprising:

a first display panel, said first display panel being a double panel formed with a folded panel attached face to face;

a second display panel;

a ductile hinge connected between said first and second display panels to hold said first and second display panels in a hinged position relative to each other;

an easel panel connected to said ductile hinge along a common hinge axis with said first and second panels to hold said easel panel in position relative to said first and second panels whereby said ductile hinge hingedly supports said first and second display panels and said easel panel relative to each other;

a calendar pad stapled through said ductile hinge; and one of said first display panel's double face to face panels having said easel panel cut therefrom and having said ductile hinge cut to allow said easel panel to be hinged therefrom.

2. A display mount in accordance with claim 1 in which said first panel and said easel panel are formed from one panel board having said ductile hinge attached thereto and said first panel being folded to form said first display panel and one of said folded panels being cut to form said easel panel.

3. A display mount in accordance with claim 1 in which said first display panel has printing thereon behind said easel cut out portion.

4. A display mount in accordance with claim 3 in which said easel panel has printing on the back thereof facing said first display panel.

5. A display mount in accordance with claim 4 in which said ductile hinge is an aluminum alloy hinge.

6. A display panel in accordance with claim 1 in which said first and second display panels are laminated and said calendar pad is stapled through said laminated and ductile hinge.

* * * * *